US007514625B2

(12) United States Patent
Suzuki

(10) Patent No.: US 7,514,625 B2
(45) Date of Patent: Apr. 7, 2009

(54) ELECTRONIC KEYBOARD MUSICAL INSTRUMENT

(75) Inventor: Yasutake Suzuki, Iwata (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/499,146

(22) Filed: Aug. 4, 2006

(65) Prior Publication Data

US 2007/0028755 A1 Feb. 8, 2007

(30) Foreign Application Priority Data

Aug. 8, 2005 (JP) ..... 2005-229503

(51) Int. Cl.
*G10H 3/12* (2006.01)

(52) U.S. Cl. ..... 84/723; 84/742; 84/631

(58) Field of Classification Search ..... 84/13, 84/19, 723, 735, 742, 746, 725, 631
See application file for complete search history.

(56) References Cited

U.S. PATENT DOCUMENTS

| | | | | |
|---|---|---|---|---|
| 3,449,531 | A * | 6/1969 | Ashworth | 381/152 |
| 3,509,282 | A * | 4/1970 | Ashworth | 381/152 |
| 5,189,242 | A | 2/1993 | Usa | |
| 5,537,908 | A * | 7/1996 | Rabe et al. | 84/454 |
| 5,981,861 | A * | 11/1999 | Van Delinder et al. | 84/743 |
| 6,351,542 | B2 * | 2/2002 | Azima et al. | 381/345 |
| 6,399,870 | B1 * | 6/2002 | Azima et al. | 84/744 |
| 6,846,980 | B2 * | 1/2005 | Okulov | 84/646 |
| 7,002,070 | B2 * | 2/2006 | Katz | 84/718 |
| 7,432,428 | B2 | 10/2008 | Kunisada et al. | |
| 2002/0148346 | A1 * | 10/2002 | Okulov | 84/613 |
| 2003/0015086 | A1 * | 1/2003 | Katz | 84/644 |
| 2005/0145100 | A1 | 7/2005 | Ramstein | |
| 2007/0028755 | A1 * | 2/2007 | Suzuki | 84/746 |

FOREIGN PATENT DOCUMENTS

| | | | |
|---|---|---|---|
| JP | 05-080750 | A | 4/1993 |
| JP | H07-092967 | A | 4/1995 |
| JP | 2782949 | B | 5/1998 |
| JP | 2001-005458 | A | 1/2001 |
| JP | 2001-272981 | A | 10/2001 |
| JP | 2003-208182 | A | 7/2003 |
| JP | 2004-294832 | A | 10/2004 |

OTHER PUBLICATIONS

Relevant portion of European Search Report for corresponding European Patent Application No. 06118375.2-2218, with issue date Dec. 12, 2006.

* cited by examiner

*Primary Examiner*—David S. Warren
(74) *Attorney, Agent, or Firm*—Rossi, Kimms & McDowell LLP

(57) ABSTRACT

An electronic keyboard musical instrument which can realize natural sounds with favorable sound quality as an acoustic piano. A sound board 33 made of a plate member is vibrated so as to generate musical tones. A first performance signal generator 22 generates a first performance signal based on the operating state of a plurality of keys of a keyboard 17. A second performance signal generator 23 generates a second performance signal, which is different from the first performance signal, based on the operation of the plurality of keys and the operation of a pedal 18. Speakers 41A to 41D generates musical tones based on the first performance signal generated by the first performance signal generator 22. Transducers 21A to 21C mounted to the sound board 33 vibrate the sound board 33 based on the second performance signal generated by the second performance signal generator 23.

6 Claims, 5 Drawing Sheets

ELECTRONIC KEYBOARD MUSICAL INSTRUMENT

BACKGROUND OF THE INVENTION

1. Field of the Invention

The present invention relates to an electronic keyboard musical instrument for generating musical tones by vibrating a sound board.

2. Description of the Related Art

Electronic keyboard musical instruments have been improved so as to be capable of reproducing natural musical tones having a spreading feeling as if being produced by acoustic musical instruments but there is still a difference in auditory sense from natural musical tones produced by acoustic musical instruments.

That is because an acoustic musical instrument produces not only musical tones sounded by vibrations of vibrating members such as strings but also sounds of contact between components of the musical instrument caused by operation of an operator such as keys and sounds produced by resonance of the respective components and sound boards in complicated interaction, and those complicated sounds can not be fully expressed by the conventional electronic keyboard musical instruments.

There is known an electronic keyboard musical instrument that produces musical tones corresponding to musical tones of operators or pedals that should be generated according to performance operation and makes the produced musical tones sound from a speaker as performance sounds, but there is a limitation in reproduction of sound in a complicated action environment caused by situations (operating state of keyboard and pedals and their operating timing and so on), which results in insufficient expression.

On the other hand, there is known an electronic keyboard musical instrument having speakers, in which a vibrating device is equipped to a sound board so that musical tones by vibration of the sound board is sounded in addition to the sounding by the speakers (See Japanese Patent Laid-Open Publication No. 7-92967).

However, by the electronic keyboard musical instrument according to Japanese Patent Laid-Open Publication No. 7-92967, sounding by the speakers and driving of the vibrating device are performed based on the same performance information generated according to keying information. Therefore, there is a room for improvement in faithful reproduction of both performance sounds by key depressing sounding like an acoustic piano and a damper sound with a spreading feeling generated by resonance and the like of strings other than the struck string when a damper pedal is operated on.

SUMMARY OF THE INVENTION

It is an object of the present invention to provide an electronic keyboard musical instrument which can realize natural sounds with favorable sound quality as an acoustic piano.

To attain the above object, according to an aspect of the present invention, there is provided an electronic keyboard musical instrument, comprising a sound board that is made of a plate member and is vibrated so as to generate musical tones, a plurality of key operators, at least one pedal operator, a first performance signal generator for generating a first performance signal based on the operating state of the plurality of key operators, a second performance signal generator for generating a second performance signal, which is different from the first performance signal, based on the operation of the plurality of key operators and the operation of the pedal operators, at least one speaker for generating musical tones based on the first performance signal generated by the first performance signal generator, and at least one vibrating device that is mounted to the sound board and vibrates the sound board based on the second performance signal generated by the second performance signal generator.

With the arrangement of the aspect of the present invention, natural sounds with favorable sound quality like an acoustic piano can be realized.

Preferably, the first performance signal is a signal to sound a performance sound according to a pitch of an operated key operator and the second performance signal is a signal to sound a damper sound corresponding to a resonance sound sounded when a damper pedal is on in an acoustic piano.

With the arrangement of the aspect of the present invention, a performance sound according to keying operation can be sounded by a speaker and also, a damper sound can be sounded by a sound board, which can realize further natural sounds.

The above and other objects, features, and advantages of the present invention will become more apparent from the following detailed description taken in conjunction with the accompanying drawings.

DETAILED DESCRIPTION OF THE PREFERRED EMBODIMENTS

Figure 1:
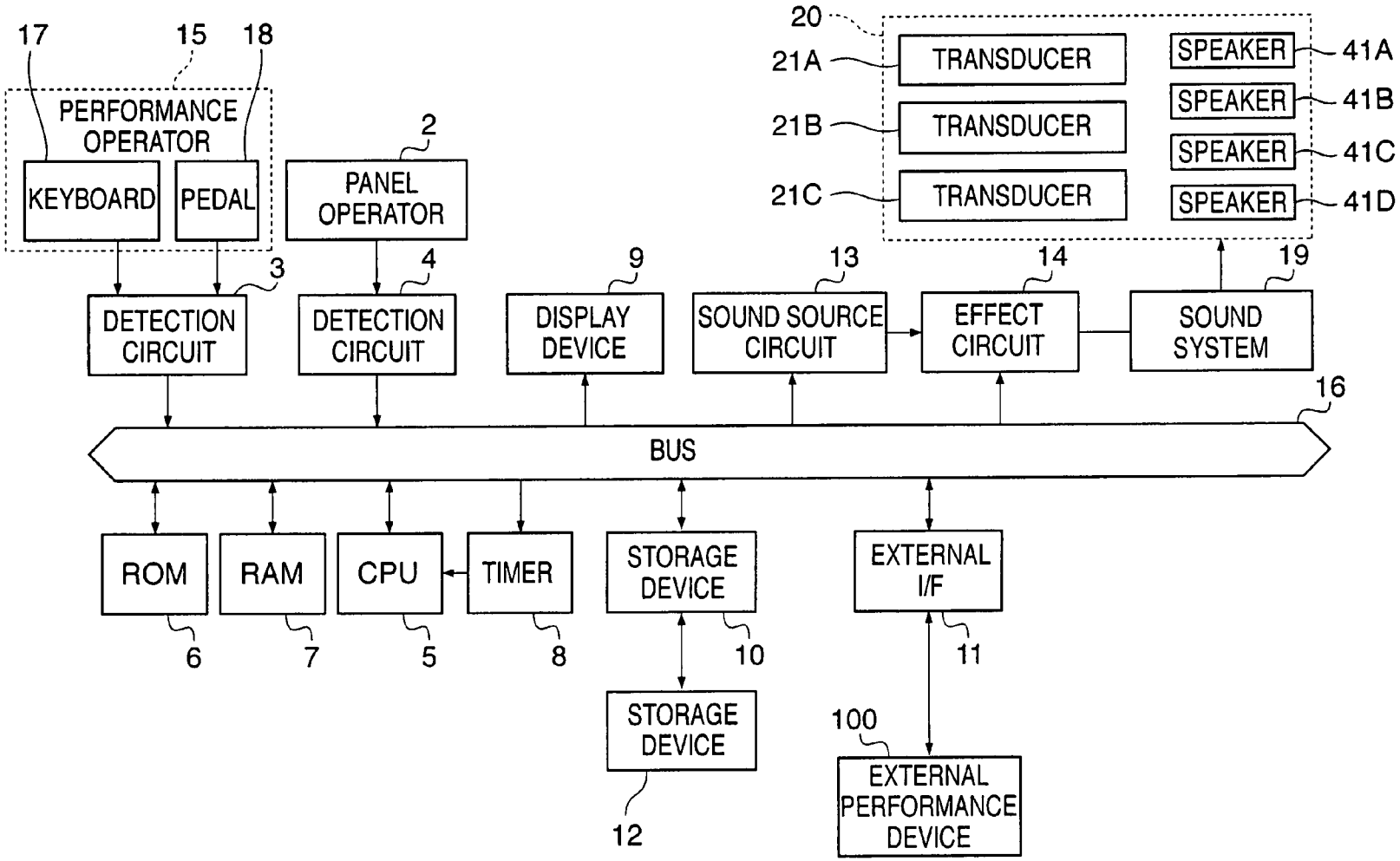
FIG. 1 is a block diagram showing an entire construction of an electronic keyboard musical instrument according to a preferred embodiment of the present invention.

A preferred embodiment of the present invention will now be described below referring to the drawings.

Figure 2:
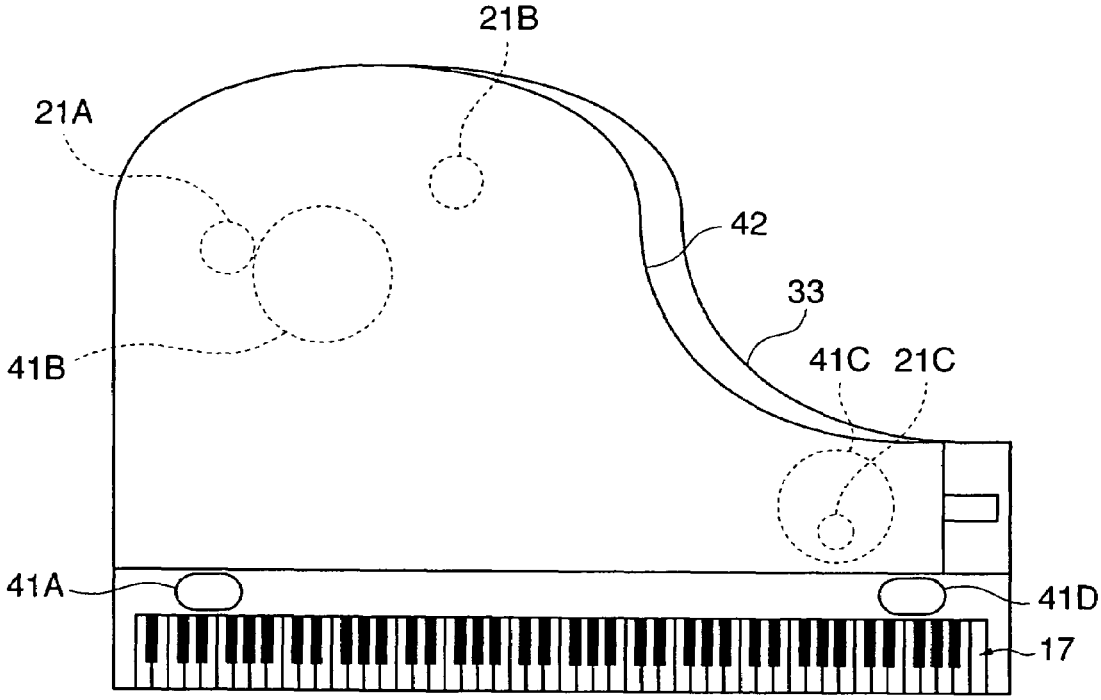
FIG. 2 is a plan view of the electronic keyboard musical instrument in FIG. 1.
Figure 3A:
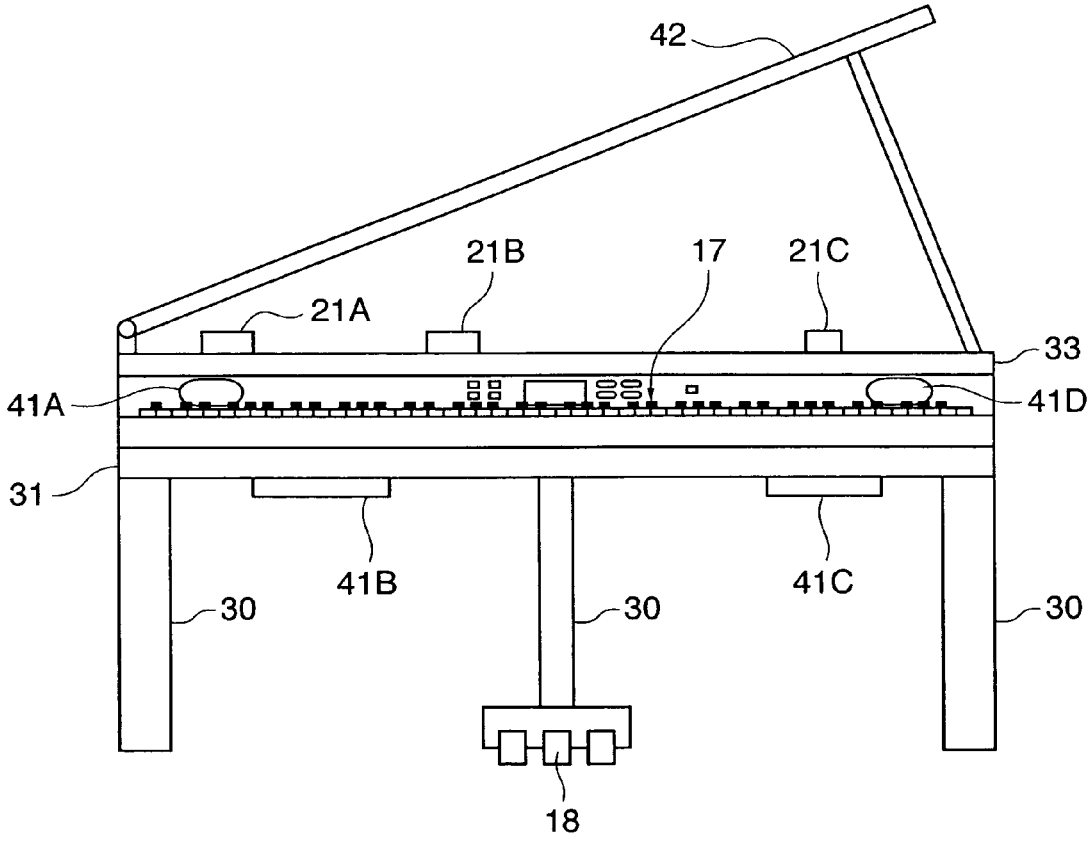
FIG. 3A is a front view of the electronic keyboard musical instrument in FIG. 1.
Figure 3B:
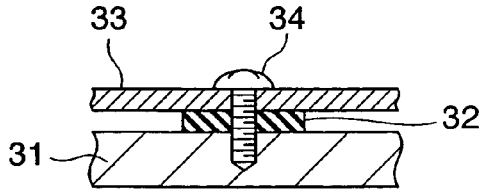
FIG. 3B is a sectional view of one of mounting portions to a frame of a sound board in the electronic keyboard musical instrument in FIG. 1.

FIG. 1 is a block diagram showing an entire construction of an electronic keyboard musical instrument according to the preferred embodiment of the present invention. FIG. 2 is a plan view of the electronic keyboard musical instrument in FIG. 1. FIG. 3A is a front view of the electronic keyboard musical instrument in FIG. 1 and FIG. 3B is a sectional view of a mounting portion to a frame of a sound board in the electronic keyboard musical instrument in FIG. 1.

An electronic keyboard musical instrument 1 comprises, as shown in FIG. 1, a detection circuit 3, a detection circuit 4, a ROM 6, a RAM 7, a timer 8, a display device 9, a storage device 10, an external interface (external I/F) 11, a sound source circuit 13 and an effect circuit 14 connected to a CPU 5 through a bus 16, respectively.

Moreover, to the detection circuit 3, a performance operator 15 is connected, and the performance operator 15 includes a keyboard 17 comprised by a plurality of keys for inputting pitch information and a damper pedal (hereinafter referred to as "pedal") 18 to be operated for performance by a foot. To the detection circuit 4, a panel operator 2 including a plurality of switches for inputting various type of information is connected. The display device 9 comprises a liquid crystal display (LCD) or the like for displaying various types of information such as musical scores, characters, etc. To the CPU 5, the timer 8 is connected, and to the external I/F 11, an external performance device 100 is connected. To the effect circuit 14, a sounding portion 20 is connected through a sound system 19. The sound system 19 includes a DAC (Digital-to-Analog Converter), an amplifier and the like.

The detection circuit 3 detects an operation state of the performance operator 15, while the detection circuit 4 detects the operation state of the panel operator 2. The CPU 5 takes care of control of the entire electronic keyboard musical instrument 1. The ROM 6 stores control programs to be executed by the CPU 5 and various table data and the like. The RAM 7 temporarily stores various input information such as performance data, text data and the like, various flags, buffer data, performance results, etc. The timer 8 measures interrupt time in timer interrupt processing and various kinds of time. The storage device 10 stores various application programs including the above control programs, various tune data (performance data such as MIDI, audio data, etc.), various data and the like.

The external I/F 11 has MIDI (Musical instrument Digital Interface) I/F and various communication I/F for inputting MIDI signals from an external device such as the external performance device 100 and the like and outputting the MIDI signal to the external device. The sound source circuit 13 converts the performance data inputted from the performance operator 15 and the performance data set in advance and the like to a musical tone signal. The effect circuit 14 imparts various effects to the musical tone signal inputted from the sound source circuit 13.

The storage device 10 is provided with a hard disk drive (HDD), for example, and the storage device 10 can read/write data from/to an external storage medium 12. The storage medium 12 may be a flexible disk drive (FDD), CD-ROM drive, magnetic optical disk (MO) drive and the like.

The sounding portion 20 includes a plurality of (four, for example) speakers 41 (41A, 41B, 41C, 41D) and a plurality of (three, for example) transducers 21 (transducers 21A, 21B, 21C). The speaker 41 generates a musical tone based on each operation of the performance operator 15 or performance data. The transducer 21 generates sound by each operation of the pedal 18 and the keyboard 17 or performance data by vibrating (exciting) a sound board 33 shown in FIG. 2. That is, in this electronic keyboard musical instrument 1, sound is also generated by vibration of the sound board 33 in addition to sounding by the speakers 41.

As shown in FIG. 3A, the pedal 18 is provided at the lower front part of a leg body 30, and a frame 31 is fixed to the upper part of the leg body 30. As shown in FIG. 2, the keyboard 17 is disposed like a grand piano on a player side (front side). The sound board 33 is disposed in the rear of the keyboard 17. The sound board 33 has, as shown in FIG. 2, the same shape on plan view as the sound board disposed under the strings in a grand piano. The sound board 33 is formed by a wood plate with the uniform thickness of about 1 cm, and the depth of the sound board 33 is shorter on the high-note side (right side in FIG. 2) than on the low-note side (left side in FIG. 2). It is to be noted that the material or thickness of the sound board 33 may be changed as appropriate in design as long as it is suited for sounding by vibration.

The plan view shape of the frame 31 is not shown but it has a frame-state shape substantially following the edge portion of the sound board 33. Specifically, the outer profile of the frame 31 is slightly smaller than the edge portion of the sound board 33 and has a similar shape to the sound board 33. As shown in FIG. 3B, the sound board 33 is fixed and held at the upper end of the frame 31 by a plurality of screws 34, which are arranged separately from each other with appropriate intervals, through a rubber plate member 32. As the rubber plate member 32, it is preferable to use such a material that has a high buffering function so that vibration of the sound board 33 is not transmitted to the leg body 30.

An opening/closing lid 42 capable of opening/closing as the one in an acoustic grand piano is provided above the sound board 33. In FIGS. 2 and 3A, an opened state of the opening/closing lid 42 is shown. At performance, by opening the opening/closing lid 42, sounding by the speakers 41 and the sound board 33 can be emitted efficiently.

The speakers 41A and 41D are arranged at both right and left ends immediately behind the keyboard 17. The speakers 41B and 41C are fixed to stays, not shown, fixedly provided at the frame 31 and arranged under the sound board 33. As shown in FIG. 2, the speaker 41B is arranged at a position on a latter half portion of the sound board 33 on the middle-note to low-note side on a plan view, while the speaker 41C is arranged at a position on a front portion of the sound board 33 on the high-note side.

The transducers 21A, 21B, 21C are disposed separately from each other on the upper surface of the sound board 33. The transducer 21A is arranged on the low-note side of the sound board 33, the transducer 21B on the middle-note side of the sound board 33, and the transducer 21C on the high-note side of the sound board 33 in an area thereof with a short depth. In terms of longitudinal positions, the transducer 21C is located at the forefront and the transducer 21B at the backmost. The respective transducers 21A, 21B, 21C are arranged at positions where the sound board 33 can be vibrated efficiently with relatively many natural frequencies thereof in a frequency range which can be generated by a keyboard musical instrument. That is, the respective transducers 21 are arranged at positions not only avoiding positions of the screw 34 and the frame 31 but also such that the density of tangent lines corresponding to the respective natural frequencies is low when the sound board 33 is freely vibrated while the frequency is gradually changed.

The respective transducers 21 are directly mounted to the sound board 33. Methods of mounting to the sound board 33 may be any means such as screws, adhesive, etc. The construction of the transducers 21 is publicly known, as described in FIGS. 1 and 2 in page 266, "Radio Technology", March 1971, and the transducers 21 themselves are vibrated by an electric signal (performance signal or driving signal) to vibrate the sound board 33 by reaction of its own weight. The transducers 21 may be in any structure as long as they can generate sounds by vibrating the sound board 33 based on an electric signal.

In this preferred embodiment, the same construction is used for the transducers 21A and 21B. The transducers 21A, 21B are large and can support a low frequency range, in which the vibration efficiency is particularly good in the vicinity of the frequency of 250 Hz but at the frequency higher than that, a generated vibration becomes very small. Also, the intensity of the vibration which can be generated thereby is large, and mainly, sounding in a low-note range is handled thereby.

On the other hand, the transducer 21C has a different characteristic (capability) from the transducers 21A, 21B, that is, different vibration efficiency with respect to an input signal. The transducer 21C is smaller in size than the transducers 21A, 21B and can support a higher frequency range, in which the vibration efficiency above the frequency of 1000 Hz is still good. Also, the intensity of the vibration which can be generated is not as strong as those of the transducers 21A, 21B, and mainly high-note range sounding is handled.

Figure 4:
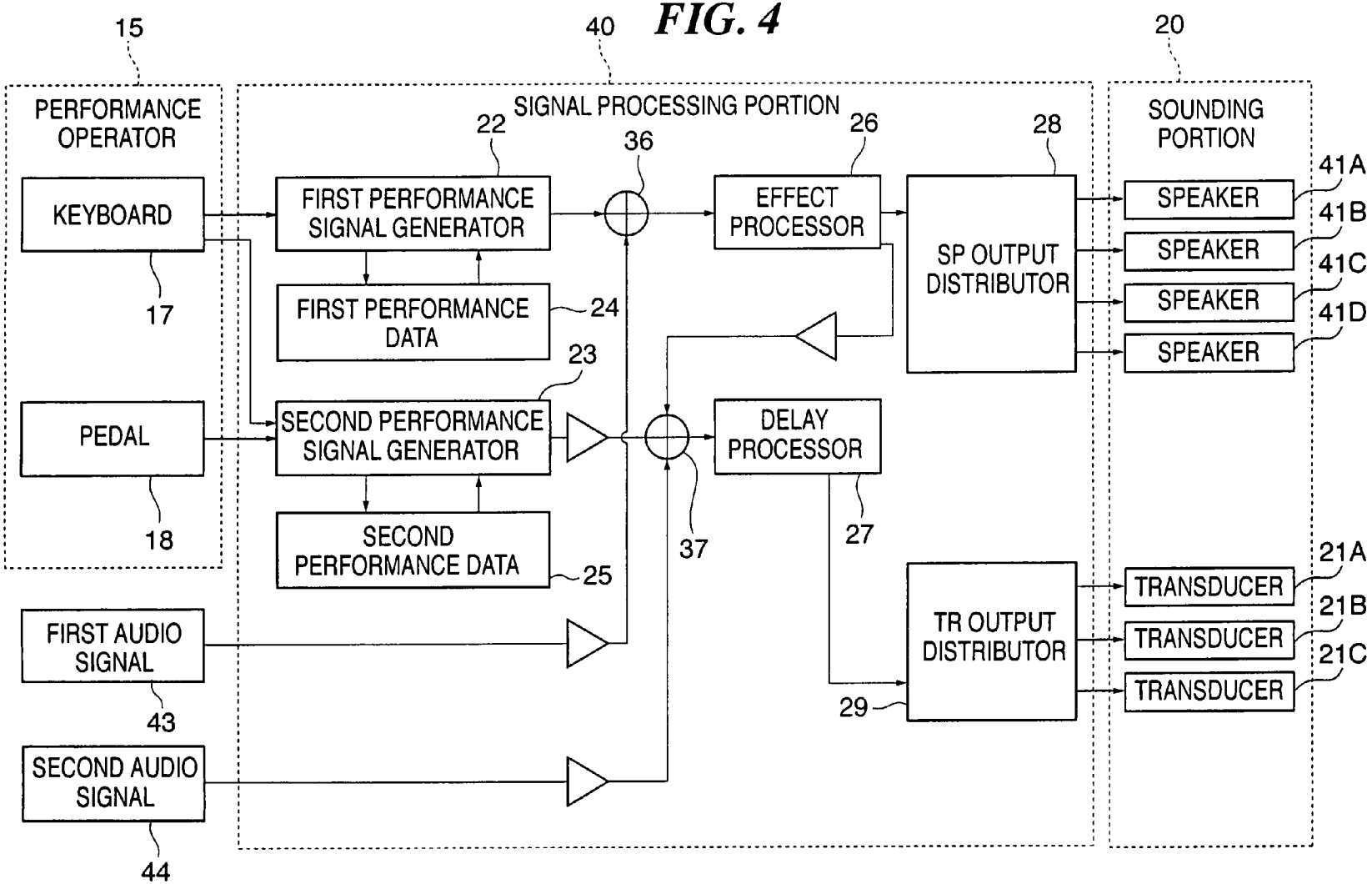
FIG. 4 is a block diagram showing a function of the electronic keyboard musical instrument in FIG. 1.

FIG. 4 shows a block diagram showing a function of the electronic keyboard musical instrument 1. A signal processing portion 40 shown in this figure has a first and a second performance signal generator 22, 23, a first and a second performance data 24, 25, adders 36, 37, effect processor 26, delay processor 27, SP output distributor 28, TR output distributor 29 and the like as function portions. These functions of the respective function portions of the signal processing portion 40 are realized by cooperation of components including the CPU 5, the ROM 6, the RAM 7, the timer 8, the storage device 10, the external interface 11, the sound source circuit 13, the effect circuit 14, the sound system 19, etc. shown in FIG. 1.

The first performance data 24 is a waveform data obtained by sampling musical tones by pitch which are sounded when each key is operated without stepping on the damper pedal in an acoustic grand piano. On the other hand, the second performance data 25 is a waveform data obtained by subtracting data corresponding to the first performance data 24 from the musical tones sampled by pitch which are sounded when each key is operated while stepping on the damper pedal. That is, the first performance data 24 is data to reproduce normal performance sounds. The second performance data 25 is data to reproduce damper sounds with spread feelings by resonance and the like of strings other than those struck when the damper pedal is operated in an acoustic piano. These are stored in the ROM 6, for example.

The first performance signal generator 22 generates a first performance signal using the first performance data 24 according to key pressing/releasing operation of each key on the keyboard 17 and sends it to the effect processor 26 through the adder 36. On the other hand, the second performance signal generator 23 generates a second performance signal using the second performance data 25 according to operation of the pedal 18 and the keyboard 17 and sends it to the delay processor 27 through the buffer and the adder 37. The first performance signal is to make the speaker 41 sounded, while the second performance signal is to drive the transducer 21, and the both are different in characteristics.

When a first and a second audio signals 43, 44 are inputted, the first audio signal 43 is sent to the effect processor 26 through the buffer and the adder 36, while the second audio signal 44 is sent to the delay processor 27 through the buffer and the adder 37.

Here, the first and the second audio signals 43, 44 are signals stored in the storage device 10 or inputted from the external performance device 100 and they are signals having a source of audio data with a plurality of (2, for example) tracks. The first audio signal 43 is a signal to reproduce normal performance sound and corresponds to the first performance signal in real-time performance. The second audio signal 44 is a signal to reproduce damper sound and corresponds to the second performance signal in the real-time performance. The audio data is created in advance as data for playing back the normal performance sound and the damper sound.

The first audio signal sent to the effect processor 26 and the first performance signal 43 are given effects which are set at the effect processor 26 and supplied to the SP output distributor 28 and also sent to the delay processor 27 through the buffer and the adder 36. On the other hand, the second performance signal sent to the delay processor 27, the second audio signal 44 and the signal sent from the effect processor 26 are subjected to predetermined delay processing at the delay processor 27 and supplied to the TR output distributor 29.

The SP output distributor 28 distributes output power to the speakers 41 based on the signal (first performance signal, first audio signal 43) supplied from the effect processor 26. That is, the signal is distributed, amplified and outputted to each of the speakers 41A to 41D. At that time, output is made according to the pitch and velocity specified by the signal, but output power distribution to the respective speakers 41 to realize sound field localization is set so that each of outputs from the speakers 41A to 41D matches the operated key pitch or the pitch specified by the first audio signal 43.

The TR output distributor 29 distributes output to the transducers 21 based on the supplied signal (second performance signal, second audio signal 44, etc.). That is, an analog driving signal is generated, amplified and outputted for each of the transducers 21A, 21B, 21C. Specifically, a driving signal making each of the transducers 21A, 21B, 21C vibrate with a frequency according to the pitch specified by the signal and intensity according to the velocity is generated/outputted.

Figure 5:
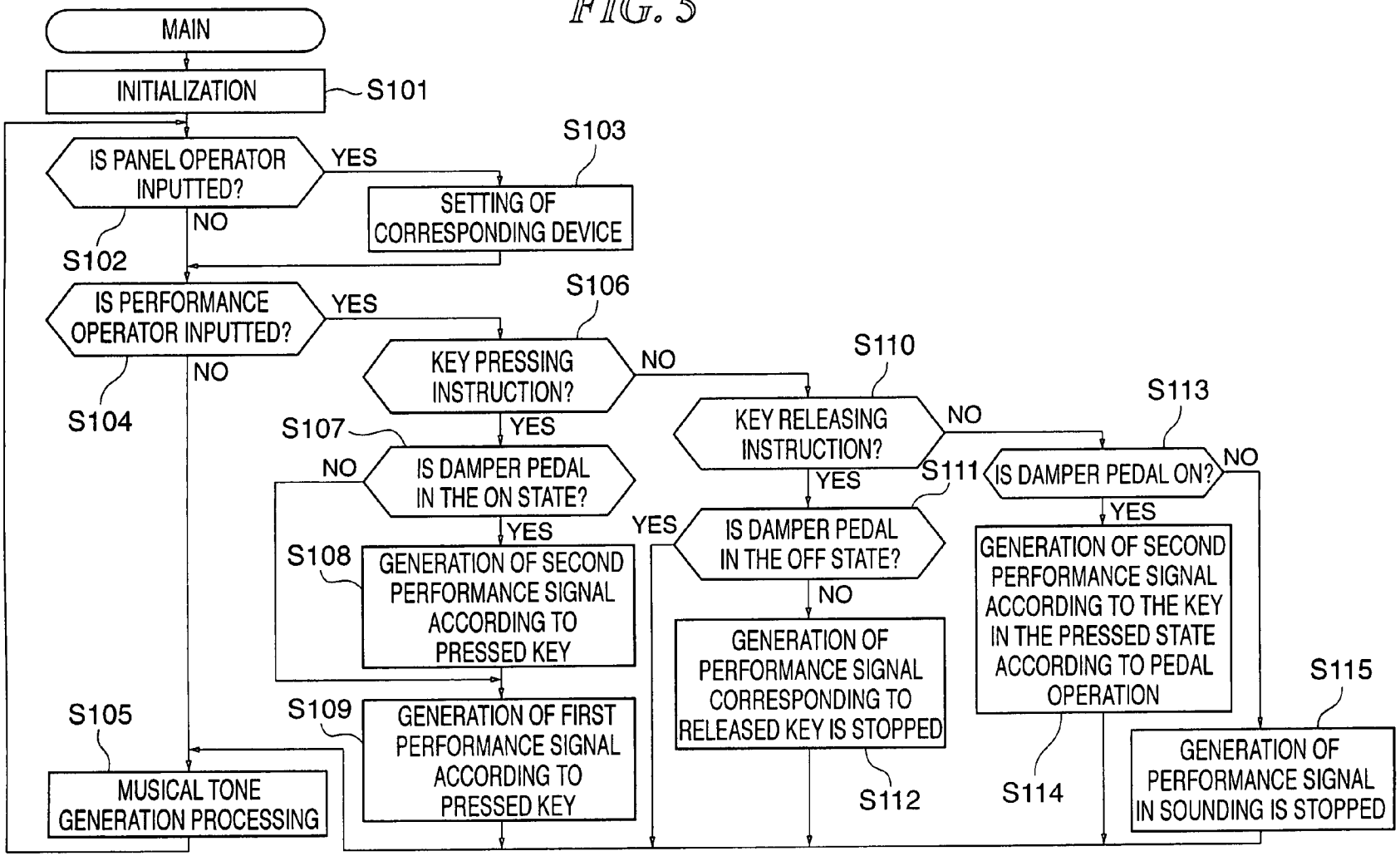
FIG. 5 is a flowchart of a main processing.

FIG. 5 is a flowchart of a main processing. This processing is started when power is turned on.

First, initialization is executed, that is, execution of a predetermined program is started, and initial values are set to various registers such as the RAM 7 for carrying out initial setting (Step S101). Then, an input of the panel operator 2 is checked (Step S102), and setting of equipment corresponding to the input (sound volume, timbre, effect setting, availability of automatic performance execution, etc.) is executed (Step S103). And it is determined if there was an input of a performance operator 15 (Step S104), and if not, the program goes on to Step S105, while if there was an input, it is determined if the input is key pressing instruction (pressing of a key of the keyboard 17) or not (Step S106).

Based on the determination result, if that is not a key pressing instruction, it is determined if that is a key releasing instruction or not (Step S110). And if that is not the key releasing instruction, either, it is determined if that is on operation of the pedal 18 or not (Step S113), and if that is not the on operation of the pedal 18, either, that is an off operation of the pedal 18, and the program goes on to Step S115. Therefore, if the input of the performance operator 15 is the key pressing instruction, Steps S107 to S109 are executed, while if the input is the key releasing instruction, Steps S111, S112 are executed. And if the input is the on operation of the pedal 18, Step S114 is executed, while if the input is the off operation of the pedal 18, Step S115 is executed, and in the respective cases, the program goes to Step S105.

First, at the above Step S107, it is determined if the pedal 18 is now in the on state or not. And if the pedal 18 is not in the on state, the program goes to Step S109, where the first performance data 24 according to the pitch of the pressed key (key which has been pressed) is read out of the ROM 6 and based on the first performance data 24, the first performance signal having an envelope according to the pressed key velocity is generated. On the other hand, if the pedal 18 is in the on state, the program goes to Step S108, where the second performance data 25 according to the pitch of the pressed key is read out, the second performance signal having an envelope according to the pressed key velocity is generated and then, the above Step S109 is executed.

At the above Step S111, it is determined if the pedal 18 is in the on state or not. If the pedal is not on, the program goes to Step S112, where generation of the performance signal of the released key (key which has been released) is stopped. That is, a signal for tone damping processing of the corresponding musical tones being sounded is generated. In this processing, the first performance data 24 is read out and the first performance signal for tone damping having an envelope according to the key releasing operation is generated. On the other hand, if the pedal 18 is in the on state, generation of the performance signal is not stopped but the program goes on to the above Step S105.

At the above Step S114, when it is in the pressed key state and there is a tone being sounded, the second performance signal corresponding to the key in the pressed key state is generated according to the on operation of the pedal 18. That is, the second performance data 25 according to the pitch of the key in the pressed key state is read out and the second performance signal having the envelope matching the damped state of the sound in sounding processing is generated.

At the above Step S115, if there are tones being sounded corresponding to the respective pitches of keys other than the key in the pressed state, the performance signals corresponding to them are stopped. That is, a signal for tone damping is generated for tone damping processing of the corresponding musical tone being sounded. In this processing, the first performance data 24 and the second performance data 25 corresponding to the pitch of the key other than the key in the pressed state and according to the pitch being sounded are read out and the first performance signal and the second performance signal having envelopes according to the off operation of the pedal 18 are generated.

At the above Step S105, based on the above generated first performance signal and the second performance signal, signals are outputted to the respective speakers 41 and the respective transducers 21. Moreover, if execution of automatic performance was allowed and the first and the second audio signals 43, 44 have been inputted, output is made based on these signals. There are cases where outputs based on the first and the second performance signals are made as well as outputs based on the first and the second audio signals 43 and 44 at the same time.

That is, at the above Step S105, firstly, based on the first performance signal generated as above, a signal is distributed and outputted to the respective speakers 41 at the output level according to the first performance signal so that localization according to the pitch can be obtained. If the first audio signal 43 has been inputted, the same processing is carried out. By this, the normal performance sound is sounded from the speakers 41 according to the pressed keys and/or audio data.

Also, at the above Step S105, based on the second performance signal generated as above, the driving signals are individually generated and outputted, considering the characteristics and layout of the respective transducers 21, so that the localization according to the pitch can be obtained. If the second audio signal 44 has been inputted, the same processing is carried out. By this, the damper performance musical tones are generated according to the pressed keys and/or audio data. After that, the program returns to the above Step S102.

The musical tones by vibration of the sound board 33 become similar to sounds reproduced in a complicated action environment such as the operation state of the keyboard 17 and the pedal 18 and their operation timing and so on as compared with the musical tones by the speakers 41, and they are natural acoustic sounds with favorable sound quality. Particularly, since the sound board 33 has the shape similar to that of a sound board of a grand piano, its sound is similar to that of an acoustic piano. Particularly, since the shape of the frame 31 on plan view is the shape of a frame following the peripheral edge portion of the sound board 33, it is possible for the sound board 33 to be vibrated largely (with a sufficiently low frequency) in the inside area of the frame 31, and the damper sound in the low-note area can be favorably reproduced. Moreover, since the transducers 21 are arranged at positions where the sound board 33 can be vibrated efficiently, a sufficient sounding amount can be obtained.

Here, it is assumed that balance between the output level (volume) of the performance sound by the first performance signal and the output level of the damper sound by the second performance signal is determined in the fixed manner in advance. However, it is not limited but the balance between the both may be differed according to the set output levels. For example, they may be set so that the higher the set output level is, the higher the output level of the performance signal becomes than that of the damper sound.

According to the preferred embodiment, since the speakers 41 sound the performance sound by the first performance signal generated according to the operation of the keyboard 17, and the sound board 33 sounds the damper sound by driving of the transducers 21 based on the second performance signal generated according to the operation of the pedal 18 and the keyboard 17, natural sounds with favorable sound quality as an acoustic piano can be realized.

Moreover, since the sound board 33 has the shape similar to that of the sound board of a grand piano, natural sounds similar to that of the grand piano can be realized. Particularly, when a low note is sounded by vibrating the board, a wider area than an area necessary to sound high notes is required, and the shape of the sound board 33 is ideal for reproduction of piano sounds.

It may be so constituted that distribution to the speakers 41A to 41D is determined at the stage when the first performance signal is generated at the first performance signal generator 22. For example, in the first performance signal, waveforms of the right/left channels are read out of the first performance data 24 and generated as stereo signals for the right/left channels. And the signal for the left channel may be sounded by the speakers 41A, 41B, while the signal for the right channel may be sounded by the speakers 41C, 41D. In this case, the characteristics are made different between the speaker 41A and the speaker 41B as well as different between the speaker 41C and the speaker 41D so that the signal for the left channel (or for the right channel) is sounded as an appropriate signal through a filter. Specification of the number of speakers 41 may be 2 instead of 4 (only the speaker 41A and the speaker 41D, for example).

Moreover, it may be so constituted that distribution to the transducers 21A to 21C is determined at the stage when the second performance data 25 is generated at the second performance signal generator 23, as in the above. The number of transducers 21 may be 2 instead of 3, and only the transducers 21A, 21B may be provided. In that case, on the contrary to the example in FIG. 2, the left transducer 21A is arranged on the depth side, while the right transducer 21B is arranged on the front side. And as in the above, in the second performance signal, it may be so constituted that the waveforms for the right/left channels are read out of the second performance data 25 and generated as stereo signals for the right/left channels so that the transducer 21A is driven by the signal for the left channel, while the transducer 21B is driven by the signal for the right channel.

In this preferred embodiment, the sound board 33 is made in the shape of a sound board of a piano so as to reproduce piano sound more appropriately, but the shape of the sound board 33 may be any shape in terms of simple sounding, and appropriate selection of shape may be made according to the type of sound to be sounded for more appropriate sounding.

For reproduction of a violin sound, for example, ideal sounding is expected from construction in the shape of a violin.

In this preferred embodiment, the second performance signal generated by the second performance signal generator 23 (See FIG. 4) is a signal to sound a damper sound, but this is not limited but the signal may be generated for various effect sounds which can be realized by sounding of vibration of the sound board 33. In that case, a signal for controlling those effects may be generated according to operation of a pedal other than the damper pedal 18.

Also, the second performance signal is generated using the second performance data 25, but this is not limited and the first performance data 24 may be used. In that case, a waveform of a pseudo damper sound different from the first performance signal may be generated by reading out the first performance data 24 and processing a waveform of the first performance data 24 as the second performance signal.

When the second performance signal generator 23 generates the second performance signal according to operation of the pedal 18, the second performance signal may be generated, considering not only on/off of the pedal 18 but sounding in transition of operation of the pedal 18 (semi-contact state of the damper and the string between the fully contact state and the fully separated state).

In this preferred embodiment, the transducers 21 are mounted on the upper face of the sound board 33 but they may be mounted on the lower face thereof. The transducers 21A, 21B may have characteristics different from each other. Moreover, the number of the transducers 21 is at least one if it is to simply sound a damper sound, but the number is preferably 2 or more or even 4 or more from the point of view of pursuit of favorable sound quality.

What is claimed is:

1. An electronic keyboard musical instrument comprising:

a sound board made of a vibratable plate member;

a plurality of key operators;

at least one pedal operator;

a first performance signal generator for generating a first performance signal based exclusively on an operating state of said plurality of key operators and not based on an operating state of the pedal operator;

a second performance signal generator for generating a second performance signal, which is different from the first performance signal, based on operation of said plurality of key operators and operation of the pedal operators;

at least one speaker for generating musical tones based on the first performance signal generated by said first performance signal generator; and at least one vibrating device mounted to said sound board for vibrating said sound board based on the second performance signal generated by said second performance signal generator, wherein the first performance signal is for sounding a performance sound according to a pitch of an operated key operator and the second performance signal is for sounding a damper sound corresponding to a resonance sound sounded when a damper pedal is on in an acoustic piano.

2. The electronic keyboard according to claim 1, wherein the first performance signal is for driving both the at least one speaker and the at least one vibrating device, and the second performance signal is only for driving the at least one vibrating device.

3. The electronic keyboard musical instrument according to claim 1, wherein the at least one vibrating device is a transducer.

4. The electronic keyboard musical instrument according to claim 2, wherein the at least one vibrating device is a transducer.

5. An electronic keyboard musical instrument comprising:

a sound board made of a vibratable plate member;

a plurality of key operators;

at least one pedal operator;

a first performance signal generator for generating a first performance signal based on an operating state of said plurality of key operators and not based on an operating state of the pedal operator;

a second performance signal generator for generating a second performance signal, which is different from the first performance signal, based on operation of said plurality of key operators and operation of the pedal operators;

at least one speaker for generating musical tones based on the first performance signal generated by said first performance signal generator; and at least one vibrating device mounted to said sound board for vibrating said sound board based on the second performance signal generated by said second performance signal generator, wherein the first performance signal is for sounding a performance sound according to a pitch of an operated key operator and the second performance signal is for sounding a damper sound corresponding to a resonance sound sounded when a damper pedal is on in an acoustic piano, wherein the first performance signal is for driving both the at least one speaker and the at least one vibrating device, and wherein the second performance signal is for driving only the at least one vibrating device.

6. The electronic keyboard musical instrument according to claim 5, wherein the at least one vibrating device is a transducer.

* * * * *